United States Patent [19]

Lewis

[11] Patent Number: 4,601,155

[45] Date of Patent: Jul. 22, 1986

[54] ELASTIC BAND APPLICATION SYSTEM

[75] Inventor: Paul A. Lewis, Salinas, Calif.

[73] Assignees: Robert Alameda; Richard Cooper, both of Salinas, Calif.

[21] Appl. No.: 651,224

[22] Filed: Sep. 14, 1984

[51] Int. Cl.[4] ..... B65B 11/00

[52] U.S. Cl. ..... 53/176; 53/399; 53/556; 53/585

[58] Field of Search ..... 53/168, 176, 273, 291, 53/399, 414, 419, 449, 556, 582, 585, 587, 589; 100/9

[56] References Cited

U.S. PATENT DOCUMENTS

| | | | |
|---|---|---|---|
| 2,601,547 | 6/1952 | Minock | 128/303 A |
| 3,085,501 | 4/1963 | Wimmer | 100/14 X |
| 4,401,020 | 8/1983 | Brux | 53/390 X |
| 4,406,728 | 9/1983 | Ohba | 53/582 X |
| 4,442,765 | 4/1984 | Limehouse et al. | 53/390 X |
| 4,470,241 | 9/1984 | Parry et al. | 53/556 |
| 4,480,536 | 11/1984 | Burns | 53/585 X |
| 4,514,966 | 5/1985 | Konstantin | 53/585 |
| 4,519,178 | 5/1985 | Crabb, Jr. | 53/556 |

FOREIGN PATENT DOCUMENTS 2330139 1/1974 Fed. Rep. of Germany ..... 53/582

*Primary Examiner*—John Sipos
*Assistant Examiner*—Steven P. Weihrouch
*Attorney, Agent, or Firm*—Manfred M. Warren; Robert B. Chickering; Glen R. Grunewald

[57] ABSTRACT

An automatic mail banding apparatus is disclosed in which mail is positioned in a stack in a mail receiving tray and is clamped to a movable portion of the tray. A rubber band applying assembly receives a rubber band at a position along the side of the tray, expands the band while axially aligning the expanded band with the stack of mail, moves the band axially toward the stack to surround the stack with the expanded band, and then releases the band around the stack. The movable portion of the tray pivots to move the stack to a new orientation while the stack of mail remains clamped to the movable portion of the tray, and a second band is applied to the stack by the band applying assembly in a transverse orientation to the first band.

6 Claims, 9 Drawing Figures

ELASTIC BAND APPLICATION SYSTEM

BACKGROUND OF THE INVENTION

The field of this invention relates generally to systems for applying an elastic band around a product, and more particularly to systems for expanding and placing at least two elastic bands around a stack or bundle of individual items.

Schemes have been devised in the past for applying elastic bands as in the form of rubber bands around products, notably in the field of irregularly shaped foodstuffs such broccoli. U.S. Pat. No. 4,401,020 to Brux discloses a complex conveyor belt system for routing the broccoli or other product being prepared for banding. The product is finally routed to a banding station, where the product is dropped vertically into the center of a band stretching assembly which has already expanded the elastic band. Upon landing in the orafice provided by the stretching fingers and elastic band, the fingers collapse until the band is supported by the product and then the fingers are withdrawn to release the band. After banding, product drops free and is carried away. This system depends upon the irregular shape of the broccoli to release the band from the fingers.

U.S. Pat. No. 2,601,547 to Minock discloses an expander tool for elastic bands. The bands are manually placed on a circular array of moveable fingers. Handles are then squeezed for radially moving the fingers to thereby expand the elastic band. The product to be banded is manually inserted into the open center of the expanded band, the expanded band is released, and the band snaps onto the product. Even though this construction is simple and inexpensive, it does not lend itself to high production volume. Additionally, it is labor intensive because it must be operated by a human user, and is therefore costly.

U.S. Pat. No. 4,442,765 to Limehouse et al. discloses a device for preparing produce or other products for shipment. After being manually sized at a cutting station, the product is manually moved to and inserted in a banding station. Before moving the product to the banding station, the human user must manually expand an elastic band and place it over a plurality of upwardly extending spring loaded fingers. After placing the produce through the now expanded elastic band, the user depresses a foot pedal which is connected to pull the fingers downward to release the elastic band. The band snaps onto the product, and the product is manually moved to another station.

The Limehouse approach has several disadvantages. It is labor intensive; the product and the elastic band must be manually handled by a human operator. This is expensive and relatively slow. The approach is not suitable if there are a plurality of products to be banded, as for example if the product were asparagus or a stack of individual items such as individual sheets of paper. The device does not lend itself to retrofitting into an existing assembly line; individual items of product can fall through the central opening of the expanded band, and the banding device itself must be centered around the product to enclose it so the banding apparatus structure would impede movement of other cooperating structures. Elastic bands can only be applied with the product in one orientation; it is not possible. for example, to tilt the product for installing an elastic band at a second and differing orientation.

SUMMARY OF THE INVENTION

This invention improves over previous approaches used for expanding them elastic bands and applying them to a product.

The invention provides an automatic mail banding system, both apparatus and process, which is formed for encircling at least two elastic bands around a stack of pieces of mail. This is done to facilitate mail sorting, as well as to form a tight bundle of mail that will withstand rough handling. The mail banding apparatus first comprises a handling means formed for holding a plurality of pieces of mail in a stack to enable encircling the elastic bands therearound.

The mail banding apparatus is second comprised of a band applying means which is formed for automatically encircling the stack with the elastic bands to form a bundle of mail. The apparatus is third comprised of at least one of the handling means and the band applying means being mounted for movement between two positions. This is to enable encircling of the first band in a first orientation around the stack, and encircling of a second band in a second orientation around the stack. The second and first orientations are perpendicular with respect to one another.

The invention also provides an improvement wherein the apparatus is formed for movement of a single elastic band from a contracted condition and an unaligned position with respect to the stack or product, to an expanded condition and an aligned position with respect to the product.

The invention further includes a system wherein: the apparatus is formed for movement of a plurality of arms, each terminating in a finger for the receipt and the movement of the band, at least two of the arms being formed to travel different distances during movement of the band; further included is means for varying the distance traveled by the arms; and, further included is an apparatus formed for movement of a first pair of identical arms and a second pair of identical arms, each of the arms terminating in a finger for the receipt and the movement of the band, the first pair of arms being formed to travel an identical first distance and the second pair of arms being formed to travel an identical second distance.

Additional features of the invention include a system wherein: the unaligned position is laterally beside the product and the aligned position is coaxial with respect to the product; the means for releasing the band from the expanded condition comprises means for moving the band and the product with respect to each other, and means positioned with respect to the product for dislodging the band onto the product as the band and the product move with respect to each other; and, apparatus is formed for movement of the product to a first orientation and to a second orientation, each of the orientations being positioned for the product to be encircled by a band released by the means for releasing.

Several advantages are offered by this invention, a few of which are briefly mentioned here. The invention is fully automated, so it is less expensive to operate than other systems which are labor intensive. The system is uncomplicated and therefore relatively inexpensive to fabricate. Because the banding apparatus sits off to the side of a product banding station, the invention is easy to retrofit into existing product handling systems. This side mounting also permits rapid loading and it is well suited to handling a plurality of individual items such as envelopes and applying elastic bands to a stack of envelopes.

Additionally. elastic bands can be applied in at least two different orientations on the product, to thereby give additional securing power. And, the expanding portion of the invention can be adjusted to expand the elastic bands into a plurality of differing geometric shapes for wrapping products having differing shapes. By using different colored rubber bands, banded items can be sorted by color. For example, differing zip coded addresses on envelopes can be wrapped with different colored rubber bands to visually aid a worker sorting the banded stacks. This can greatly increase mail sorting speed. Also, the banding apparatus can process high volumes of product efficiently, and produce tight bundles that can withstand rough handling.

DETAILED DESCRIPTION OF A PREFERRED EMBODIMENT

Overview

Figure 1:
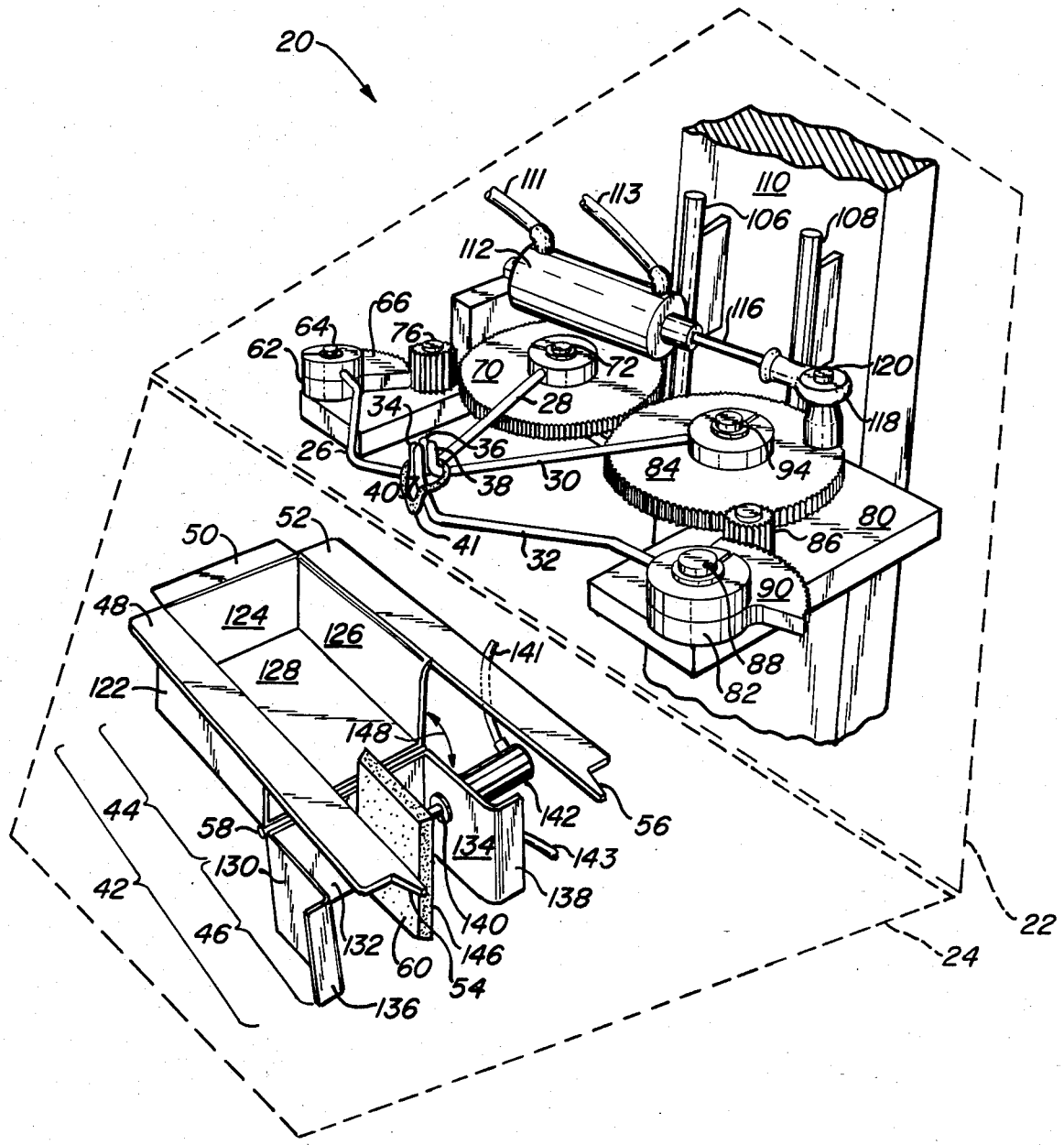
FIG. 1 is a front top right perspective view according to a first example embodiment of the invention, showing one possible gear, arm and finger construction of a banding assembly. as well as the tray for receiving, clamping and orienting a stack of envelopes for banding.

Described below and shown in the Drawings is a specific example embodiment of that which the inventor considers at present to be the best mode of fabrication, assembly and operation for carrying out the invention. This single illustration is a necessarily narrow example of merely one of the many possible ways to practice the invention. Therefore, it is to be understood that the invention itself is actually much broader in scope. as set forth in and defined by the appended claims.

Broadly stated, FIG. 1 is useful for presenting an overview of the construction and operation of the invention. Shown is an inventive banding apparatus 20 having a band applying assembly 22 and a handling assembly 24.

Band applying assembly 22 includes a plurality of pivotally mounted arms 26, 28, 30 and 32, each of which terminates at one end in a plurality of upwardly extended fingers 34, 36, 38 and 40. The fingers are formed for receiving an elastic band 42, which when dropped onto the fingers slides down over them and becomes secured around all four fingers.

Handling assembly 24 includes a tray 42 having a fixed section 44 and a moveable or pivoting section 46. Fixed section 44 terminates at its top with a plurality of flanges 48, 50 and 52. Further, flanges 48 and 52 terminate at one end with a respective outwardly extending spur 54 and 56. Pivoting section 46 is mounted to pivot 90° with respect to fixed section 44 about a hinge 58. A pressure plate 60 is moveably mounted on one side of pivoting section 46.

In operation, an elastic band is dropped or placed onto fingers 34, 36, 38, 40. Arms 26, 28, 30, 32 are pivoted to move away from one another, expanding the elastic band in the process. Simultaneously or immediately prior to this expansion, tray 42 is filled with a plurality of items such as envelopes (FIG. 3), either manually or mechanically.

Pivoting section 46 is shown in FIG. 1 in the rotated or down position. However, when tray 42 is receiving the items, pivoting section 46 begins in the up position, so the respective bottoms of fixed sections 44 and pivoting sections 46 are coplanar. Additionally, pressure plate 60 is initially against the wall on which it is mounted. After tray 42 receives the items to be banded, pressure plate 60 is moved against the items now in the tray, and the items are pressed against one side of pivoting section 46 to secure them. The items thus immobilized, the elastic band carried by the fingers is expanded, lowered, and released around the items to secure them in one orientation with an elastic band.

The fingers are now withdrawn and pivot back together, where another elastic band is wrapped around them as before. At about the same time, pivoting section 46 drops downward to move the secured items 90° into a vertical upwardly extended orientation. The finqers aqain expand the elastic band, cause it to encircle the bundle of items, and snap the band free to encircle the items. The fingers again are withdrawn to the beginning position. Pressure plate 60 is withdrawn against the wall carrying it, to release the now bundled stack of mail for further sorting.

Detail: Band Applying Assembly

More particularly stated, the specific example embodiment shown in the Drawings include additional details which amplify on the apparatus, process, and operation of the illustration described broadly in the above Overview. These additional details of the example are described below.

Figure 2:
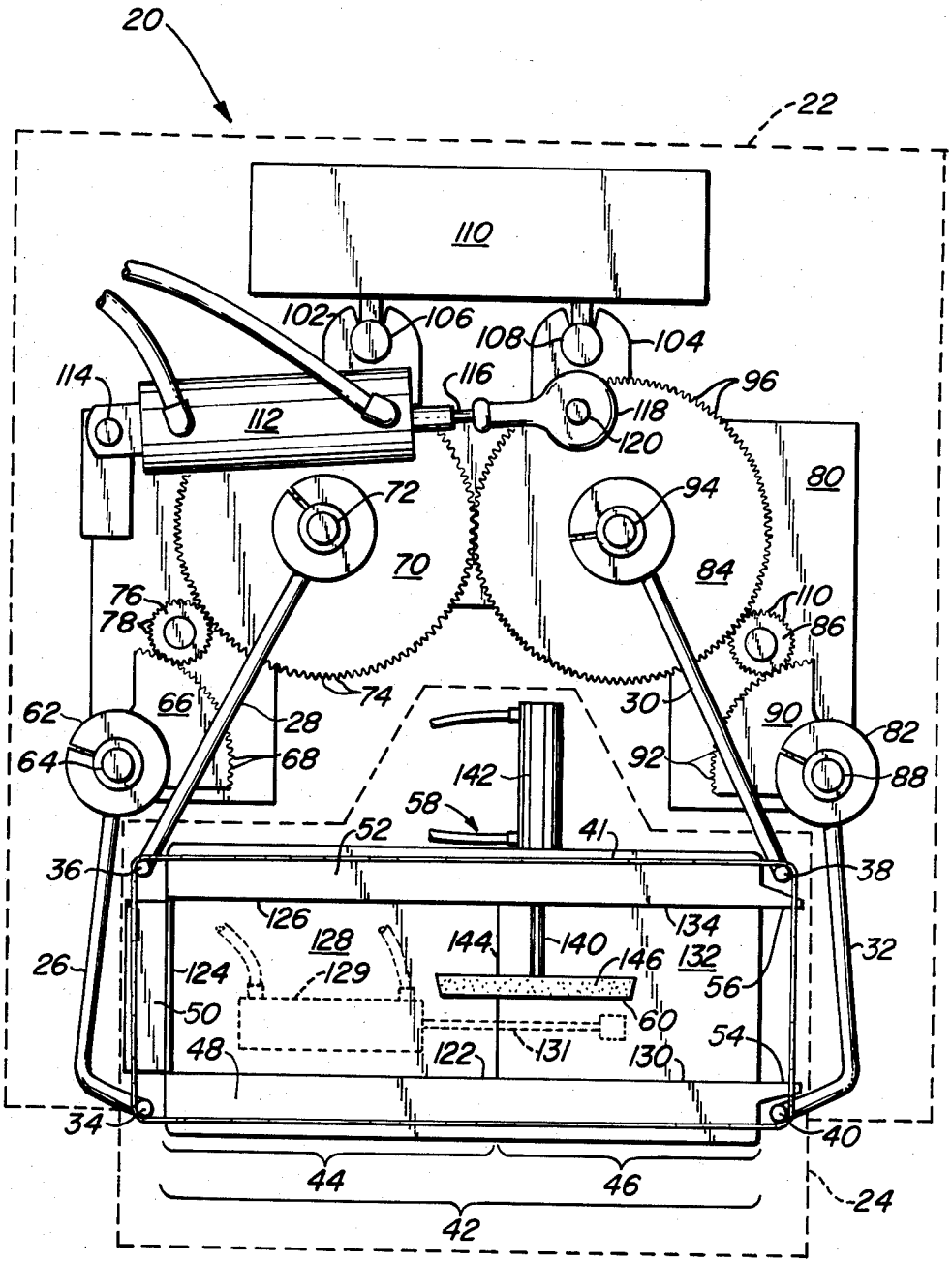
FIG. 2 is a top plan view according to the first example embodiment.

FIGS. 1 and 2 show that arms 26, 28, 30 and 32 of banding apparatus 20 are mounted to pivot by the action of a plurality of qears. Arm 26 is attached to a gear 62 mounted to pivot about a pin 64. Gear 62 has a partial arc 66 having teeth 68. Likewise. arm 28 is connected to a gear 70 which is mounted to pivot about a pin 72 and provided with a plurality of teeth 74. A coupling gear 76 is pivotally mounted with a plurality of teeth 78 which engage teeth 74 of gear 70 and teeth 68 of gear 62.

All gears are mounted on a common plate or pivot table 80.

As shown, a trio of gears 82, 84 and 86 are mounted on pivot table 80 in mirror image arrangement with respect to respective gears 62, 70 and 76. Arm 32 is attached to gear 82 which pivots about a pin 88, and includes an arc portion 90 bearing a plurality of teeth 92. Arm 30 is attached to gear 84 which pivots about a pivot pin 94, and is provided with a plurality of circumferentially arranged teeth 96. Coupling gear 86 is mounted to pivot, and has a plurality of teeth 100 which engage teeth 96 of gear 84 and teeth 92 of gear 82.

Table 80 is provided with a pair of laterally extending grippers 102 and 104 secured to a pair of posts 106 and 108 which extend from a support column 110. For driving this interconnected arrangement of gears, a pneumatic cylinder 112 is connected to table 80 to pivot about a pin 114. Carried within cylinder 112 is a piston 116 which extends over gear 70 to be anchored to gear 84 at a head 118 attached to gear 84 to pivot about a pin 120. Cylinder 112 is coupled to a suitable conventional air supply (not shown) through a hose 111 and a hose 113.

Arms 26, 28, 30 and 32 are adjustably mounted on pivot table 80. As is visible from the drawings, each gear 62, 70, 82 and 84 is mounted with an adjustable allen screw which can be loosened to change the angle of attack of each of the arms. The optimum arrangement of the arms is with fingers 34, 36, 38 and 40 touching one another at the beginning of each banding cycle.

The gear assembly of the banding apparatus has several advantages over prior art elastic band expanding devices. First, employing gears provide accurate, relatively slack-free manipulation of the expanding fingers, particularly with respect to apparatus employing drive chains. Second, the gear assembly allows positioning to one side of the banding station or handling assembly 24 which greatly enhances material handling functions. Thus, rapid loading and unloading of items into tray 42 can be accomplished from the top or bottom and three sides of the tray. Alternatively, a plurality of trays can be conveyed to and from the handling station, all while an elastic band is loaded or positioned on fingers 34, 36. 38 and 40. An additional advantage is that selection of the appropriate gear ratios combined with a seletion of the apropriate arm lengths readily can be used to create expanded band openings of various symetrical and asymetric sizes and shapes.

Detail: Handling Assembly

FIGS. 1 and 2 show the detail of handling assembly 24. In addition to the parts identified in the Overview, handling assembly 24 includes a plurality of sides 122, 124 and 126 joined at 90° with respect to each other, and bonded at 90° to a common fixed floor 128. As shown, flanges 48, 50 and 52 are attached to extend from these respective sides 122, 124 and 126.

Pivoting section 46 has a cross-section substantially identical to the geometry formed by sides 122, floor 128 and sides 126 of fixed section 44. Pivoting section 46 includes a side 130 joined at right angles to a floor 132, which in turn is joined at right angles to a side 134. Sides 130 and 134 terminate in their upper reaches with a respective flange 136 and 138, formed to fit beneath and adjacent the undersides of respective flanges 48 and 52 when pivoting section 46 is in the up position as shown in FIG. 2. A cylinder 129 is attached to the underside of floor 128, and coupled with a piston 131 to the bottom of floor 132 to rotate pivoting section 46 up and down.

FIG. 2 shows that pressure plate 60 is carried by a piston 140, mounted to be moved pneumatically by a cylinder 142 secured to side 134 of pivoting section 46. FIGS. 1 and 2 show pressure plate 60 partially extended into the interior of handling assembly 24, representing a typical stop position of pressure plate 60 after moving in to secure a bundle of items such as mail (see FIG. 3). At the beginning of a cycle, however, pressure plate 60 is withdrawn toward cylinder 142 to be flush with side 134 of pivoting section 46. Cylinder 142 is connected through a pair of hoses 141 and 143 to a conventional source of pressurized air (not shown).

As can be seen in FIG. 2, pressure plate 60 in the up position of pivoting section 46, overlaps a portion of floor 128 of fixed section 44, along a seam 144 between floor sections 128 and 132. Hinge 58 resides directly beneath seam 144. Pressure plate 60 overlaps floor 128 because pressure plate 60 has a rectangular shape having a longer side 146 disposed parallel to floor sections 128 and 132. As more easily seen from FIG. 1, pivoting section 46 is mounted to pivot about hinge 58 approximately 90° as shown by an arrow indicated at 148.

Detail: Operation

Cylinder 112 is coupled with a pair of hoses 111 and 113 to a source of pressurized air (not shown).

In use during a mail bundling operation, a typical cycle can be considered as involving six steps.

For step 1, band applying assembly 22 begins as shown in FIG. 1, with fingers 34, 36, 38 and 40 together in contact with one another ready to receive elastic band 41. Handling assembly 24 begins a cycle with pivoting section in the up position as shown in FIG. 2, with floors 128 and 132 coplanar. Pressure plate 60 will rest against side 134 of pivoting section 46 so piston 140 will not impede mail envelopes being loaded into handling assembly 24.

The operation here is described for bundling a stack of mail and envelopes into a bundle having two elastic bands wrapped around it at 90° with respect to each other. However, if only one elastic band is wrapped around the bundle, then only a three step procedure is required to apply the elastic band.

In step two, envelopes are fed into tray 42 from the right end as shown in FIG. 2. During this envelope feeding cycle, an elastic band is simultaneously dropped onto the fingers in preparation for expansion of the elastic band. When envelopes have filled tray 42, cylinder 142 is actuated to move piston 140 and pressure plates 60 toward sides 122 and 130 of tray 42. Piston 140 finally stops as shown in FIG. 2 with the envelopes clamped firmly against side 130 of pivoting section 46. The stack of envelopes is ready to receive an elastic band therearound.

At step 3, the elastic band is moved from the contracted condition and an unaligned position with respect to the mail or any other product (FIG. 1), to the expanded condition and an aligned position with respect to the mail (FIG. 2). From FIGS. 1 and 2, it can be seen that arms 26 and 32 have the same length and shape and travel through the same distance from the contracted condition or unexpanded condition (FIG. 1) to the expanded condition (FIG. 2).

When in the contracted condition of FIG. 1, the arms and therefore the fingers 34, 36, 38 and 40 as well as elastic band 41 are adjacent handling assembly 24 with band 41 contracted. As the arms and fingers are moved to the expanded condition of FIG. 2, elastic band 41 is expanded and aligned over the stack held within tray 42. As with arms 26 and 32, the arms 28 and 30 have the same length and shape and travel through the same distance when moving from the FIG. 1 contracted condition to the FIG. 2 expanded position. As will be seen this is a non-radial expansion of the band which is particularly useful in connection with banding non-circular products.

After the fingers are in the FIG. 2 expanded condition, support column 110 is lowered, which in turn lowers pivot table 80, pulling the fingers and elastic band with it. As elastic band 41 moves downward, it encounters a releasing means in the form of flanges 48, 50 and 52, and fingers or spurs 54 and 56. As fingers 44 36, 38 and 40 continue their downward movement, elastic band 41 is pulled free of the fingers.

In step 4, gears 66, 70, 84 and ninety are pivoted back to the FIG. 1 starting position to move the fingers back into contact for receipt of another elastic band. At about the same time. pivoting section 46 rotates 90° through arc 148. The stack of mail clamped by pressure plate 60 likewise moves 90° to be oriented straight up and down with respect to tray bottom 128.

In step 5, step 3 is repeated. That is, the arms and spurs 54 and 56 move from the FIG. 1 position to the FIG. 2 position, to in turn move and also expand elastic band 41 to the position shown in FIG. 1. Support column 110, having been raised back to the starting position in step 4, is once again lowered to position elastic band 41 around the stack of mail. As the fingers continue to move downward, elastic band 41 again encounters the flanges and fingers to be pulled free from the fingers. The arms and fingers are then retracted and support column 110 moves back upward to the starting position shown in FIG. 1.

In step 6, cylinder 142 is again activated, this time to pull piston 140 and therefore pressure plate 60 away from side 130 of pivoting section 46. This releases the bundle of mail, now wrapped with two elastic bands which are arranged at 90° with respect to one another. A new cycle can now begin.

The sequence of the steps are more finely delineated in FIGS. 3A–3G. Because these are partial schematic views, much of the detailed structure is omitted. All of the FIG. 3 views are front elevation views of FIG. 2.

Figure 3A:
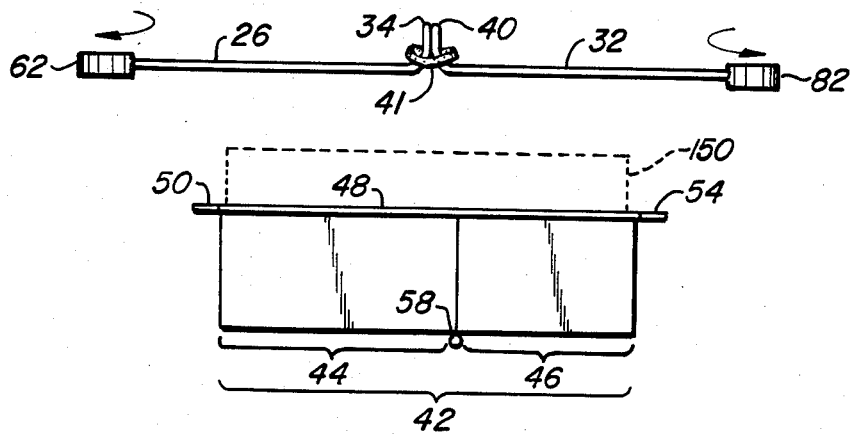
FIGS. 3A–3G are front elevation schematics of FIG. 2, showing a sequence of applying two elastic bands according to the first example embodiment.

In FIG. 3A, arms 26 and 32 are at the beginning position with fingers 34 and 40 substantially in contact with elastic band 41 encircling the fingers. A stack 150 of mail or other individual items is gathered in tray 42 and clamped in place by pressure plate 60 (not visible here, but shown in FIG. 2).

Figure 3B:
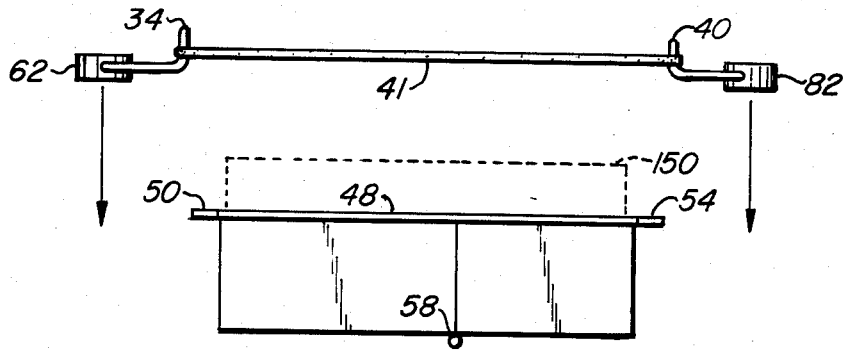
Figure 3C:
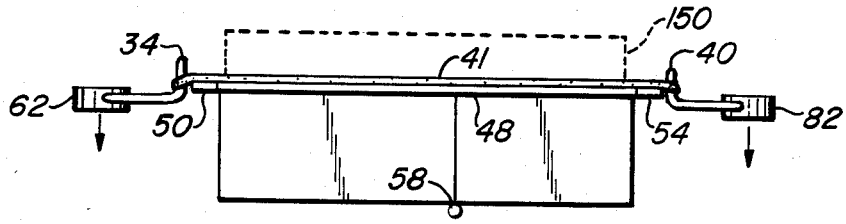
Figure 3D:
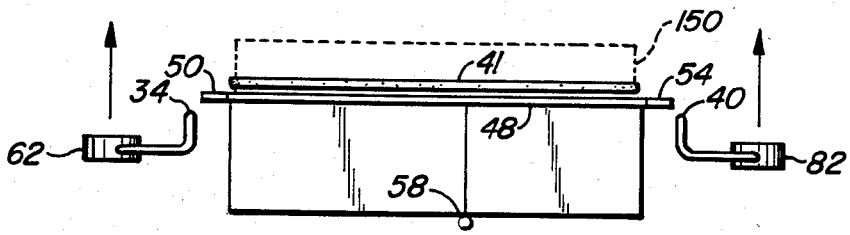

In FIG. 3B, gears 62 and 88 are rotated outward so fingers 34 and 40 move apart and over stack 150; this can also be seen in FIG. 2. In FIG. 3C, the gears, arms and fingers are moved downward around stack 150 until elastic band 41 encounters flanges 48, 50, 52 and spurs 54, 56. In FIG. 3D, just before the gears are moved back upward, elastic band 41 has been pulled off the fingers by the flanges, to be wrapped around stack 150. The gears move upward as indicated in FIG. 3D and rotate as shown in FIG. 3E back to the beginning position with fingers 34 and 40 once again in contact.

Figure 3E:
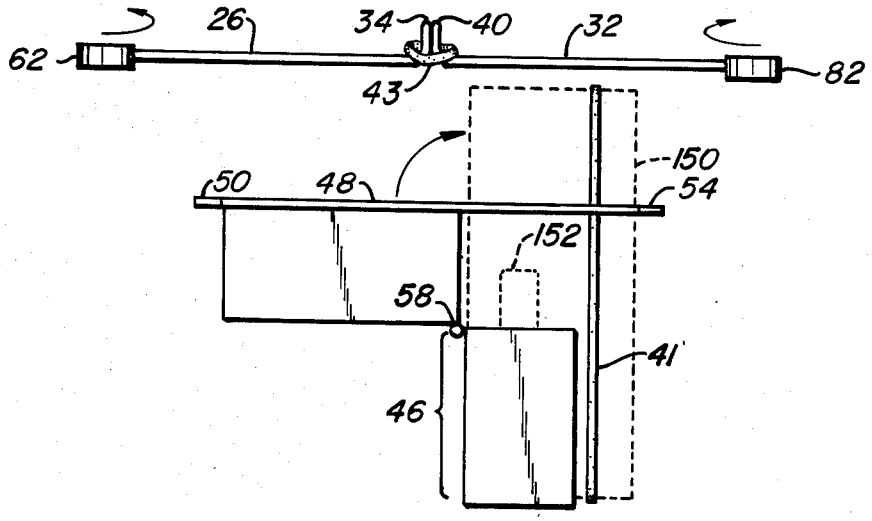

In FIG. 3E, a second elastic band 43 is dropped onto the fingers as before. At about the same time, stack 150 is pivoted 90° on hinge 58 by dropping pivoting section 46 down from the horizontal. Thus positioned, stack 150 reveals an address 152 of an addressee. Note that elastic band 41 is mounted off-center on stack 150 so as not to obscure address 152 from visual reading.

Figure 3F:
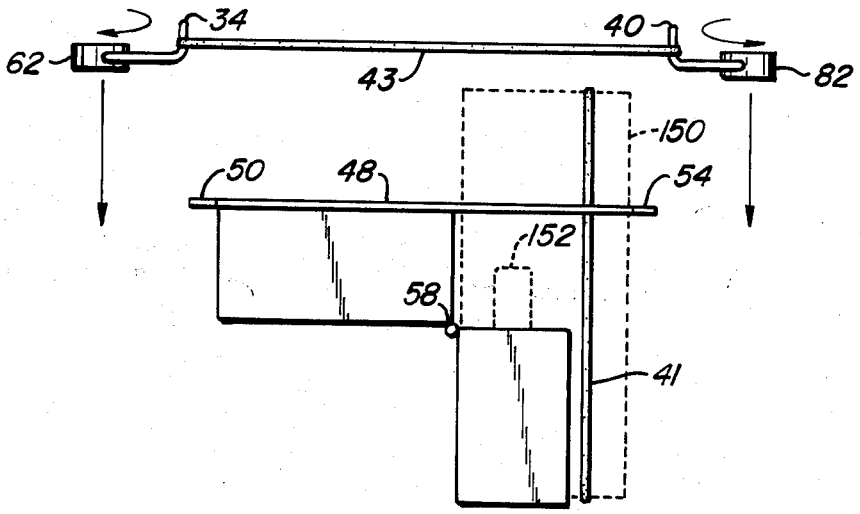
Figure 3G:
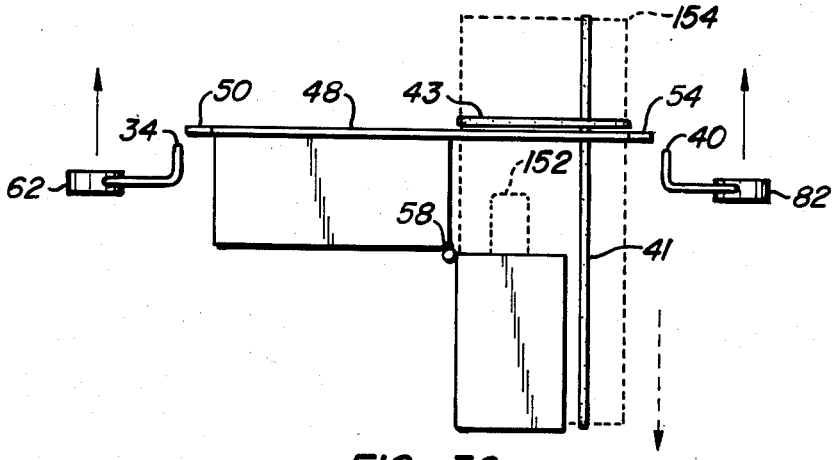

The previous banding procedure is repeated, this time using elastic band 43. Fingers 34 and 40 are moved apart to expand elastic band 43, during which the elastic band becomes aligned (as in FIG. 2) over stack 150 as shown in FIG. 3F. Now expanded, band 43 is moved downward toward flanges 50 and 48 and finger 54. As fingers 34 and 40 move further downward from the FIG. 3F position to the FIG. 3G position, elastic band 43 encounters and is stopped by the flanges and spurs 54, 56. As fingers 34 and 40 continue downward, elastic band 43 is pulled free of fingers 34 and 40 to snap onto what now is a bundle 154. Once again, elastic band 43 is off-center so as not to obscure address 152. With bundle 154 thus formed, pressure plate 60 (FIG. 2) is withdrawn to release the bundle to fall free in a downward direction as indicated by the downward arrow.

With the foregoing clearly in mind, this invention provides an automatic mail banding apparatus 21 formed for encircling at least two elastic bands 41, 43 around a stack 150 of pieces of mail to facilitate mail sorting and form a tight bundle 154 of mail that will withstand rough handling. The mail banding apparatus 20 if first comprised of a handling means 24 formed for holding 42, 44, 46, 60 a plurality of pieces of mail in a stack 150 for encircling the elastic bands 41, 43 therearound.

The banding apparatus is second comprised of a band applying means 22 formed for automaticly encircling 34, 36, 38, 40 the stack 150 with elastic bands 41 to form a bundle 154 of mail. The apparatus 20 is third comprised of at least one of the handling means 24 and the band applying means 22 being mounted for movement between two positions (FIGS. 3A–3D, FIGS. 3E–3G) to enable encircling of a first band 41 in a first orientation (FIG. 3D) around the stack 150, and encircling of a second band 43 in a second orientation (FIG. 3G) around the stack 150, with the second orientation being perpendicular to the first orientation.

The apparatus 22 further comprises an apparatus wherein: the handling means 24 includes a clamping means 60 formed for firmly clamping the stack within the handling means; and, the band applying means 22 comprises: first. an expanding means 34, 36, 38, 40 formed for expanding the elastic bands 41, 43; second a positioning means 34, 36, 38, 40, 110, 80 for positioning the elastic bands 41,43 and the stack 150 with respect to each other so the elastic bands encircle the stack at the two positions; and third, a releasing means 48, 50, 52, 54, 56 for releasing the elastic bands from the expanding means when in the two positions.

The invention also comprises an apparatus wherein: the expanding means 22 is mounted for rapid loading and unloading of the handling 24 as a result of the expanding means being formed for movement of the bands 41, 43 from an unexpanded condition (FIG. 1) and an unaligned position (FIG. 1) with respect to the stack 150 to an expanded condition (FIG. 2) and an aligned position (FIG. 2) with respect to the stack.

Note that different sequences can be used for both expanding the band and aligning the band. For example. the band can first be expanded at the unaligned position (FIG. 1), and then moved to the aligned position (FIG. 2). Or, the band can be aligned (FIG. 2) and then expanded (FIG. 2) at this aligned position. Also, bands 41 and 43 can be selected to have different colors so a bundle of mail can be differentiated by the differing colored bands.

As noted, all the preceeding specifics merely illustrates the invention. However, the invention itself is defined broadly by the appended claims.

What is claimed is:

1. An automatic mail banding apparatus for encircling two elastic bands round a stack of pieces of mail with one of said bands oriented transversely to the other of said bands, said banding apparatus including mail receiving tray means, releasable clamping means mounted to said tray means and formed to hold said pieces of mail in a stack in said tray means, and band applying means mounted proximate said tray means and formed to expand an elastic band and position the expanded band around said stack in said tray means and to release the expanded band for application to said stack, wherein the improvement in said mail banding apparatus comprises:

said tray means having a movable portion mounted for movement between a first orientation and a second orientation transverse to said first orientation, said clamping means being formed to clamp said pieces in said stack to said movable portion of said tray means for movement therewith while clamped in said tray means, means for moving said movable portion and clamping means for displacement thereof between said first orientation and said second orientation, said tray measns being formed to expose a portion of said stack for release of an elastic band therearound in each of said first orientation and said second orientation; and said band applying means being formed for release of a first band around said stack in said first orientation and for release of a second band around said stack when said stack is in said second orientation.

2. The apparatus of claim 1 wherein, said band applying means is positioned beside said tray means and is formed for movement of said bands toward, over, and around said stack from the position beside said tray means for both of the orientation of said stack.

3. The apparatus of claim 1 wherein, said movable portion of said tray means is mounted for pivotal movement with repsect to the remainder of said tray means.

4. The apparatus of claim 1, wherein, band applying means is formed for expansion of the band into a rectangle having a greater length dimension than width dimension.

5. The apparatus of claim 1 wherein, band applying means is formed for releasing the expanded bands by axially translating said expanded bands with respect to said tray means to cause said expanded bands to encounter, stop against, and be forced off band applying means by said tray means to cause said bands to contact and encircle the product.

6. An automatic mail banding apparatus including mail holding means formed to hold pieces of mail together in a stack with a portion of said stack exposed for the receipt of an elastic band therearound, and band applying means mounted proximate said holding means and having a plurality of fingers formed for receipt of an elastic band thereon and for expansion of said band to an expanded condition by separation of said fingers, said band applying means further including support means, a gear assembly mounted to said support means, and drive means coupled to drive said gear assembly, said fingers being provided on movable arms coupled to said gear assembly for coordinated separation of said fingers to expand said band, wherein the improvement in said banding apparatus comprises:

said gear assembly being formed for movement of said arms between:

(i) a position over said support means in which said fingers are in close proximity to each other for receipt of an elastic band thereof, and (ii) a postion lateral of said support means and substantially axially aligned with said stack in which said fingers are separated and said band is in an expanded condition, said support means being mounted for axial displacement of said arms with respect to said stack when said arms are aligned with said stack to a position for release of said band around said portion of said stack, and displacement means coupled to said support means for axial displacement thereof, said mail holding apparatus includes tray means tiltable between a first and a second orientation and means for moving said tray means, and clamping means clamping said mail in a stack in said tray means for movement therewith; and said gear assembly expands said band into a position substantially axially aligned with and surrounding said stack in both said first and said second orientation.

* * * * *